313-414 SR
10/11/83 XR 4,409,514

United States Patent [19]
Shefer et al.

[11] 4,409,514
[45] Oct. 11, 1983

[54] ELECTRON GUN WITH IMPROVED BEAM FORMING REGION

[75] Inventors: Joshua Shefer, Princeton; Carmen A. Catanese, Rocky Hill, both of N.J.

[73] Assignee: RCA Corporation, New York, N.Y.

[21] Appl. No.: 258,805

[22] Filed: Apr. 29, 1981

[51] Int. Cl.[3] ..... H01J 29/48
[52] U.S. Cl. ..... 313/449; 313/411; 313/414
[58] Field of Search ..... 313/411, 414, 447, 300, 313/307, 449; 315/16

[56] References Cited

U.S. PATENT DOCUMENTS 3,772,554 11/1973 Hughes ..... 313/69
4,234,814 11/1980 Chen et al. ..... 313/412
4,319,163 3/1982 Chen ..... 313/414 X

FOREIGN PATENT DOCUMENTS 53-70663 6/1978 Japan ..... 313/414
1142608 2/1969 United Kingdom .
2036415 12/1978 United Kingdom .

OTHER PUBLICATIONS

RCA Television Service Data, File 1981 C-7, Chassis CTC 101 Series, RCA Corporation, Consumer Electronics, 1981.
"Focusing on the New Panasonic 'Quintrix' Color TV Picture Tube", by David H. Carpenter, pp. 52 and 53 of Audio Video, Feb., 1974.

*Primary Examiner*—Eugene R. La Roche
*Attorney, Agent, or Firm*—Eugene M. Whitacre; Dennis H. Irlbeck

[57] ABSTRACT

An electron gun for use in a cathode ray tube includes beam forming electrodes and beam focusing electrodes. A gun improvement comprises the beam forming electrodes including a cathode, a control grid adjacent to the cathode and two screen grids. A first screen grid is located adjacent to the control grid. A second screen grid is located between the first screen grid and the beam focusing electrodes. Preferably, the second screen grid and the control grid are grounded.

16 Claims, 7 Drawing Figures

VOLTS

| PT. | $V_1$ | $V_2$ | $V_2'$ | $V_3$ |
|---|---|---|---|---|
| 1 | 0 | 546 | 2121 | 7600 |
| 2 | 0 | 559 | 1795 | 7500 |
| 3 | 0 | 605 | 605 | 7050 |
| 4 | 0 | 618 | 264 | 6900 |
| 5 | 0 | 623 | 130 | 6900 |
| 6 | 0 | 628 | 0 | 6900 |
| 7 | 0 | 631 | -81 | 6900 |
| 8 | 0 | 635 | -175 | 7000 |
| 9 | 0 | 637 | -248 | 7200 |

ELECTRON GUN WITH IMPROVED BEAM FORMING REGION

BACKGROUND OF THE INVENTION

This invention relates to electron guns, such as used in cathode ray tubes, and particularly to an improved beam forming region for such electron guns. The invention may be incorporated into many different types of cathode ray tubes, which in turn may be incorporated into many different types of television receivers. The invention also may be incorporated into many different types of electron guns; however, in the following description, the invention is described with respect to an in-line electron gun which is used in a slit-mask line-screen cathode ray tube having a self-converging deflection yoke, which in turn is used in a television receiver.

An in-line electron gun is one designed to generate at least two, and preferably three, electron beams in a common plane and to direct the beams along convergent paths to a small area spot on the screen. A self-converging yoke is one designed with specific field nonuniformities which automatically maintain the beams converged throughout the raster scan without the need for convergence means other than the yoke itself.

The performance of an electron gun is indicated by the spot diameter of the area of a screen excited by an electron beam from the gun. It is known that such performance is degraded by spherical aberrations and space charge effects. These effects are present in various parts of an electron gun including the beam forming and beam focusing regions of the gun.

In one recently developed electron gun described in U.S. Pat. No.4,234,814, issued to Chen et al., Nov. 18, 1980, the beam forming region of an electron gun is improved by incorporation of a thick 20 mil (0.508 mm), versus 5 mil (0.127 mm), G2 screen grid electrode. Although this thick G2 electron gun produces an electron beam with a smaller spot diameter, further improvement in spot size is very desirable.

SUMMARY OF THE INVENTION

An electron gun for use in a cathode ray tube includes an improved beam forming region and a beam focusing region. The beam forming region comprises beam forming electrodes including a cathode, a control grid adjacent to the cathode, and two screen grids. A first screen grid is located adjacent to the control grid, and a second screen grid is located between the first screen grid and the beam focusing region. In one embodiment, the first screen grid is at a higher electrical potential than the second screen grid. In another embodiment, the second screen grid is electrically connected to the control grid. In a preferred embodiment, the control grid and the second screen grid are grounded.

DETAILED DESCRIPTION OF THE PREFERRED EMBODIMENT

Figure 1:
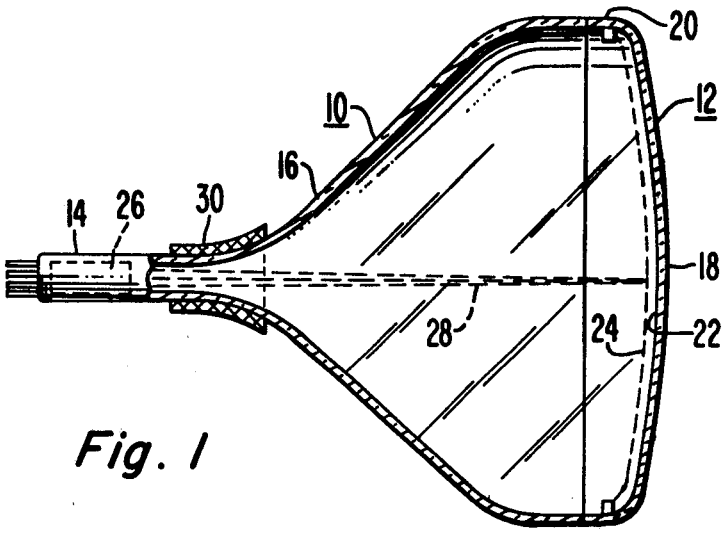
FIG. 1 is a schematic plan view of a cathode ray tube embodying the novel electron gun.

FIG. 1 illustrates a cathode ray tube 10 having a glass envelope comprising a rectangular faceplate panel 12 and a tubular neck 14 connected by a rectangular funnel 16. The panel 12 comprises a viewing faceplate 18 and a peripheral sidewall 20. A mosaic three-color phosphor screen 22 is disposed on the inner surface of the faceplate 18. The screen is preferably a line screen with the phosphor lines extending perpendicular to the intended direction of high frequency scanning. A multi-apertured slit-type color selection shadow mask electrode 24 is removably mounted by conventional means in predetermined spaced relation to the screen 22. A novel in-line electron gun 26, shown schematically by dashed lines, is centrally mounted within the neck 14 to generate and direct three electron beams 28 along coplanar convergent paths through the mask 24 to the screen 22.

The tube of FIG. 1 is designed to be used with an external magnetic deflection yoke 30 disposed around the neck 14 and funnel 16 in the neighborhood of their junction, for scanning the three electron beams 28 horizontally and vertically in a rectangular raster over the screen 22. The yoke is preferably self-converging.

Except for the improvements hereinafter described, the electron gun 26 may be of the three-beam in-line type similar to that described in U.S. Pat. No. 3,772,554, issued to Hughes on Nov. 13, 1973, or in U.S. Pat. No. 4,234,814, issued to Chen et al. on Nov. 18, 1980. The Hughes and Chen et al. patents are herein incorporated by reference for the purpose of their disclosures.

The tube 10 may be used in a television receiver such as disclosed in *RCA Television Service Data, File* 1981, *C-7, Chassis CTC* 101 *Series,* published by RCA Corporation, Consumer Electronics, in 1981. For the purpose of its disclosure, this publication is also herein incorporated by reference. Any modifications to the chassis described in this publication to obtain the excitations described hereinafter are well within the capabilities of those skilled in the art.

Figure 2:
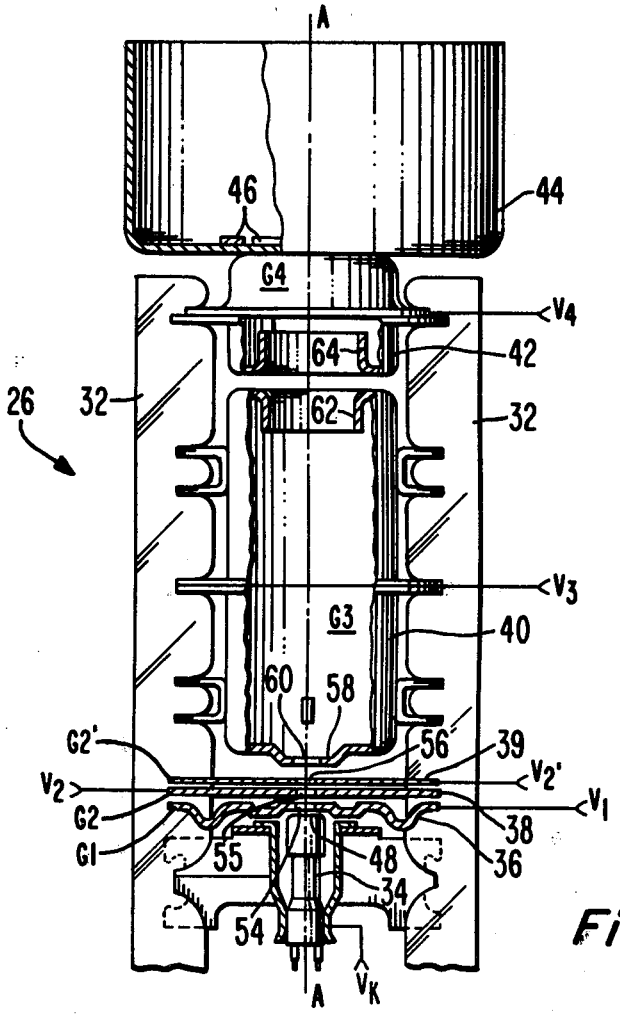
FIG. 2 is a longitudinal elevation, partly in section, of one embodiment of the novel electron gun of FIG. 1 showing a G2′ screen grid electrode.

FIG. 2 is an elevation, in partial central longitudinal section, of the three-beam electron gun 26, in a plane perpendicular to the plane of the coplanar beams of the three guns. As such, structure pertaining to but a single one of the three beams is illustrated in the drawing. The electron gun 26 is of the bipotential type and includes two glass support rods 32 on which the various electrodes are mounted. The electrodes comprise two regions, a beam forming region and beam focusing region. The electrodes in the beam forming region include three equally-spaced coplanar cathodes 34 (one shown), a control grid (G1) electrode 36, and a two-part screen grid comprising a first electrode plate (G2) 38 and a second electrode plate (G2′) 39. The electrodes at the beam focusing region comprise a first lens or focusing (G3) electrode 40, and a second lens or focusing (G4) electrode 42. An electrical shield cup 44 is attached to the G4 electrode. All of these electrodes are aligned on a central beam axis A—A and mounted in spaced relation along the glass rods 32 in the order named. The focusing electrodes G3 and G4 also serve as accelerating electrodes in the bipotential gun 26.

Also shown in the electron gun 26 are a plurality of magnetic members 46 mounted on the floor of the shield cup 44 for the purpose of coma correction of the raster produced by the electron beams as they are scanned over the screen 22. The coma correction magnetic members 46 may be, for example, those described in the aforementioned U.S. Pat. No. 3,772,554.

The tubular cathode 34 of the electron gun 26 includes a planar emitting surface 48 on an end wall thereof. The G1, G2 and G2′ electrodes comprise transverse plates which have aligned apertures 54, 55 and 56, respectively, therein. The G3 comprises two elongated rectangular cup-shaped members attached at their open ends. A first of these G3 members has a transverse wall 58, adjacent to the G2′, with an aperture 60 therein. The G4, like the G3, comprises two rectangular cup-shaped members attached at their open ends. Both the G3 and G4 electrodes have apertures 62 and 64, respectively, at their facing ends between which the main focusing lens of the electron gun is established.

In one embodiment of the novel gun 26, the dimensions presented in Table I were used.

TABLE I

| | mils | mm |
|---|---|---|
| Cathode - G1 spacing (hot) | 3 | 0.076 |
| G1 thickness | 5 | 0.127 |
| G1 aperture diameter | 25 | 0.635 |
| G1-G2 spacing | 11 | 0.279 |
| G2 thickness | 10 | 0.254 |
| G2-G2′ spacing | 5 | 0.127 |
| G2′ thickness | 6 | 0.152 |
| G2 aperture 55 diameter | 25 | 0.635 |
| G2′ aperture 56 diameter | 25 | 0.635 |
| G2′-G3 spacing | 29 | 0.737 |
| G3 aperture 60 diameter | 60 | 1.524 |
| G3 length | 925 | 23.495 |
| G3 lens diameter | 214 | 5.436 |
| G4 lens diameter | 227 | 5.766 |
| G3-G4 spacing | 50 | 1.270 |

Figure 3:
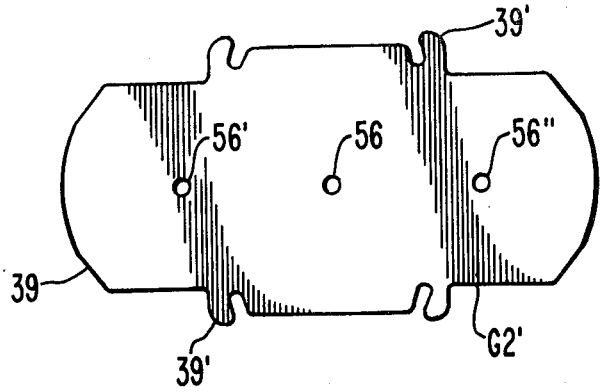
FIG. 3 is an elevation view of the G2′ screen grid electrode of the gun of FIG. 2.

FIG. 3 illustrates further detail of the G2′ electrode plate 39. With the exception of their different thicknesses, the G2 is similar to the G2′ in construction. The G2′ is shown as a flat plate, but may include various embosses for added strength. The G2′ electrode plate 39 has three in-line apertures 56, 56′ and 56″ which are aligned with the electron beam paths. The plate 38 also includes two claw portions 39′ which are normally embedded in the two glass support rods 32.

The beam forming apertures 56, 56′ and 56″ of the G2′ are preferably circular in cross-section, although other cross-sectional shapes can be employed. Circularity of the apertures is preferred because a circular beam spot on the screen is ideally desired. Accordingly, it is desirable to introduce a limited amount of astigmatism into the beam forming region so that the undesirable flare of the beam spot can be eliminated without distorting the shape of the intense core of the beam spot from its otherwise desired circular symmetry.

Figure 4:
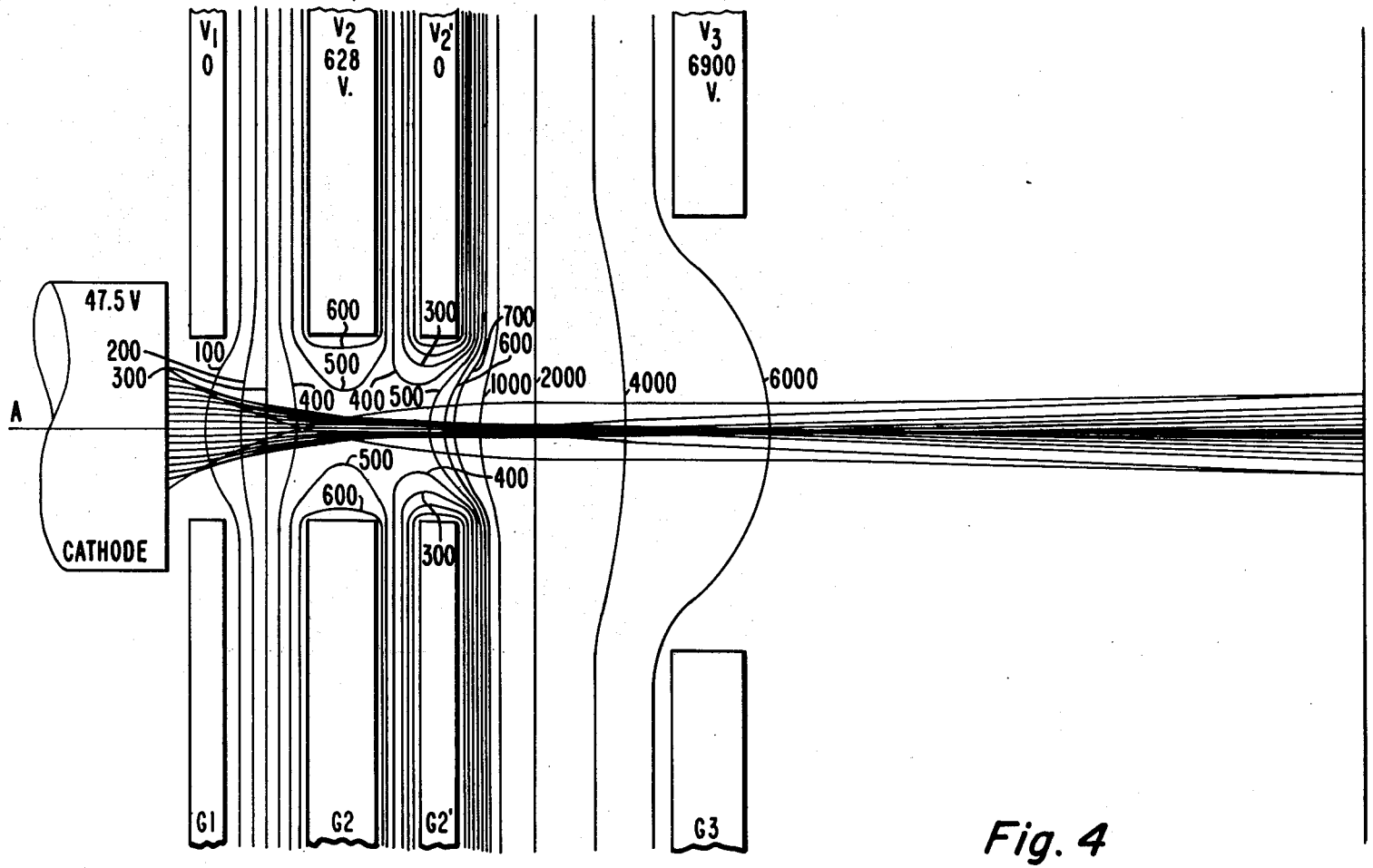
FIG. 4 is a schematic representation of the beam forming region of the gun of FIG. 2, showing electrostatic lines of equipotential and the principal electron beams emitted from a cathode.

In the preferred embodiment of the electron gun 26, the G2′ electrode plate 39 and the G1 control grid 36 are connected to ground potential. FIG. 4 shows electrostatic lines of equipotential in the beam forming region of the electron gun 26 when the following voltages are applied: cathode ($V_K$), 47.5 volts; G2 ($V_2$), 628 volts; G3 ($V_3$), 6900 volts; and G1 and G2′ ($V_1=V_{2'}$), 0 volts. The improved results utilizing this preferred embodiment can be seen by comparing the beam diameters attained, on the one hand, with the G1 and G2′ grounded and, on the other hand, with the G2′ potential equal to the G2 potential. The latter case, where $V_{2'}=V_2$, produces results very similar to those attained for a thick G2 type gun as described in the aforementioned U.S. Pat. No. 4,234,814. Table II presents beam diameters at the screen, $D_S$, and beam diameters in the deflection plane, $D_B$, for these two sets of electrical potentials for three different ultor voltages ($V_4$) and a beam current of 3.5 mA.

TABLE II

| | $V_4$ = 22kV | | $V_4$ = 25kV | | $V_4$ = 30kV | |
|---|---|---|---|---|---|---|
| | $D_S$ (mm) | $D_B$ (mm) | $D_S$ (mm) | $D_B$ (mm) | $D_S$ (mm) | $D_B$ (mm) |
| $V_{2'}=V_1=0$ | 3.01 | 2.00 | 2.76 | 1.62 | 2.26 | 1.60 |
| $V_{2'}=V_2$ | 4.07 | 1.98 | 3.51 | 1.86 | 2.78 | 1.75 |

Although in the preferred embodiment of the invention $V_{2'}=V_1$, broader aspects of the invention cover other excitations of the beam forming electrodes. These broader aspects now are explained with respect to FIG. 5.

Figure 5:
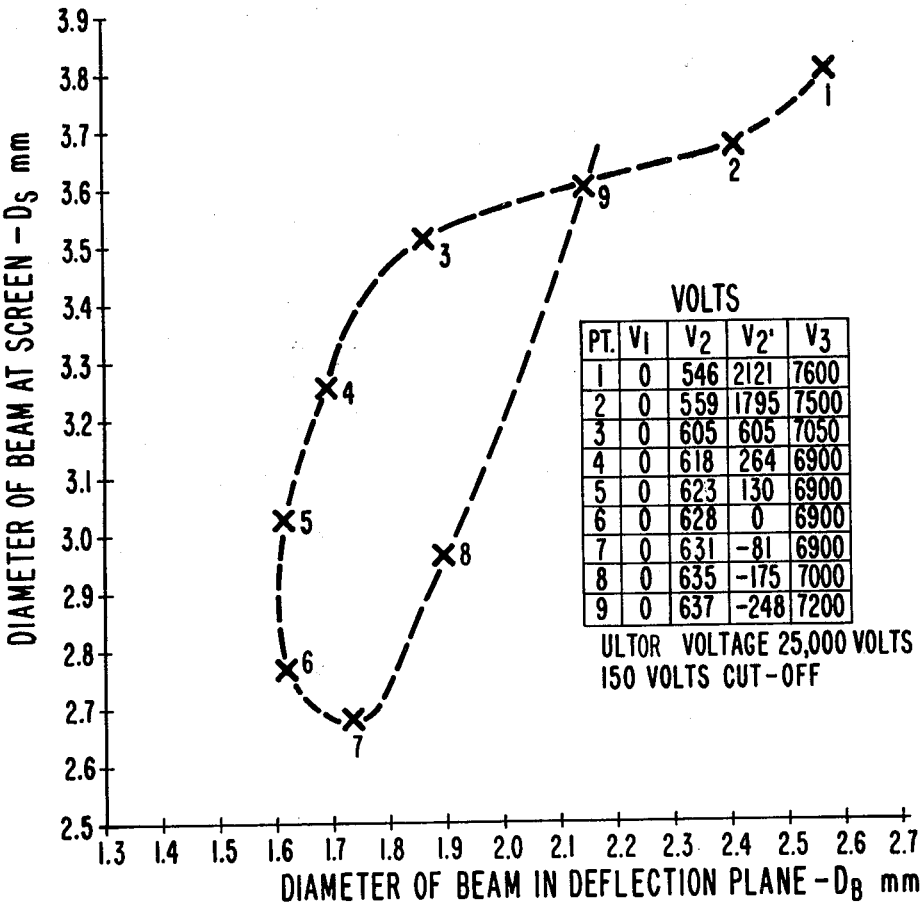
FIG. 5 is a graph of beam diameter at the tube screen versus beam diameter in the deflection plane, for various voltages applied to the electrodes. A table is included showing the voltages related to the data points.

FIG. 5 is a graph of calculated electron beam diameter at the tube screen $D_S$ versus electron beam diameter in the deflection plane $D_B$, for various voltages applied to the G2, G2′ and G3 electrodes. The table in FIG. 5 lists the specific voltages that provided the nine data points on the graph. As the voltage $V_{2'}$ applied to the G2′ electrode is decreased from 2121 volts, both the beam diameter at the screen and the beam diameter in the deflection plane decrease. Somewhere between points 5 and 6, however, the beam diameter starts increasing in size while the beam diameter at the screen continues to decrease. The beam diameter at the screen is at minimum near point 7, where the voltage on the G2′ is −81 volts. Continuing to decrease the voltage on the G2′ (i.e., driving it more) causes the curve to rise almost linearly to point 9, which closes a loop in the curve between points 2 and 3. Inspection of the graph shows that for the particular gun structure disclosed herein, optimum beam sizes exist in the region of points 6 and 7. Operation at either one of these points offers various advantages. With the G2′ excited at −81 volts, the smallest beam diameter is at the screen. However, in some instances, it is more desirable to obtain a smaller beam diameter in the deflection plane. Operation at point 6, where the beam diameter at the screen is less than 0.1 mm larger than it is at point 7, is preferable especially since no voltage need be applied to the G2′ electrode. It should be noted that, at point 3, the G2 voltage $V_2$ equals the G2′ voltage $V_{2'}$. This is similar to having a one-piece thick G2. Prior to the present invention, point 3 represented the extent of performance attained with a thick G2 type electron gun.

Actual measured beam diameters at the screen $D_S$, for a tube having an improved electron gun wherein the G1 and G2′ both were grounded and the ultor voltage $V_4$ was 25 kV, are shown in Table III.

TABLE III

| Beam Current I | Beam Diameter $D_S$ |
|---|---|
| 3.5 mA | 3.00 mm |
| 1.0 | 1.79 |
| 0.25 | 1.17 |

Figure 6:
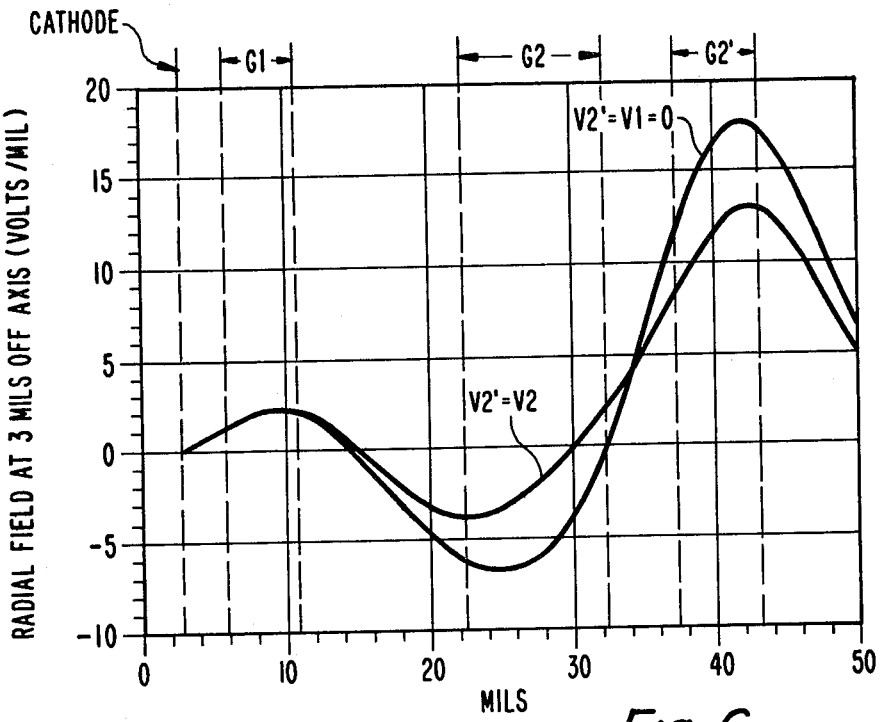
FIG. 6 is a graph of the radial electrostatic field acting on an electron beam located 0.076 mm (3 mils) off axis versus distance along the electron gun.

FIG. 6 is a graph of the radial electrostatic field acting on an electron beam which is 0.076 mm (3 mils) off the central longitudinal axis of the gun versus distance along the gun. The purpose of this graph is to provide one possible explanation why better gun performance is attained when the G2′ electrode is grounded. The curve labeled $V_{2'}=V_2$ is for the case where either the G2 and G2′ are electrically connected or there is a single thick G2. This curve reaches about a −157 volts/mm (−4 volts/mil) radial field strength at the G2 and about a +492 volts/mm (+12.5 volts/mil) radial field strength at the G2′. In effect, then, the radial electrostatic field is causing the electron beams to widen near the G2 since the field is negative, but to compact near the G2′ since the radial field is positive. Both of these effects are increased when both the G2′ and the G1 are grounded, as shown by the curve labeled $V_{2'}=V_1=0$. This latter curve reaches a radial electrostatic field value of about −275 volts/mm (−7 volts/mil) near the G2 and a radial electrostatic field value of about +689 volts/mm (+17.5 volts/mil) at the G2′. It is thought that the net effect of the increased negative field at the G2 is to reduce the angle with respect to the axis that the outer electrons, such as shown in FIG. 4, make when traversing the G2 region. Because this angle is reduced, the outer electrons make less of an angle after they cross over and therefore form a smaller beam. It is at this point, where space charge also becomes a major factor, that the increased positive field at the G2′ takes over the further acts to keep the electrons within a smaller beam. These effects can be increased further by the application of a negative voltage to the G2′ as also taught by the present invention.

Figure 7:
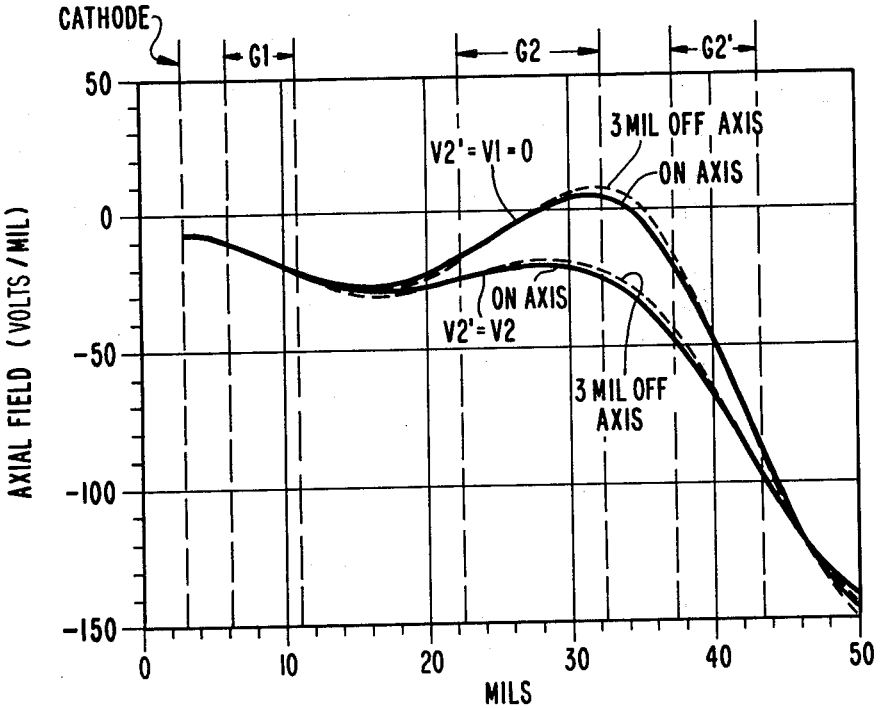
FIG. 7 is a graph of the axial electrostatic field acting on electron beams versus distance along the electron gun.

FIG. 7 is a graph of the axial electrostatic field acting on electron beams in a gun where $V_{2'}=V_2$ and in a novel gun where $V_{2'}=V_1=0$. The $V_{2'}=V_2$ curve is completely below the zero field axis, indicating that the axial electrostatic field is always causing acceleration of the electrons away from the cathode and toward the screen. The $V_{2'}=V_1=0$ curve, however, is substantially different. Although there is a general axial electrostatic field for accelerating electrons from the cathode, there is also a minor portion of the axial field above zero, beginning near a central portion of the G2 and continuing into the space between the G2 and G2′, which has a reversed axial electrostatic field for retarding acceleration of electrons. It is believed that this is the first gun having any axial electrostatic field which retards the acceleration of electrons in the beam forming region. This effect may be further enhanced by applying a negative voltage to the G2′ as indicated by the graph of FIG. 5.

It should be noted that, in designing the gun embodiments described herein, many tradeoffs may be made in design. For example, grid spacing may be varied for variations in grid thickness or for variations in aperture diameter, or vice-versa. Most of these tradeoffs, where they do not relate to the present invention, are within the knowledge of those skilled in the art.

What is claimed is:

1. In an electron gun for use in a cathode ray tube, said gun including beam forming electrodes and beam focusing electrodes, the improvement comprising said beam forming electrodes including a cathode, a control grid adjacent to said cathode and two screen grids, a first of said screen grids being adjacent to a side of said control grid opposite said cathode and a second screen grid being between said first screen grid and said beam focusing electrodes, and said second screen grid and said control grid being electrically connected.

2. The electron gun as defined in claim 1 wherein said control grid and said second screen grid are electrically grounded.

3. In an electron gun for use in a cathode ray tube, said gun including beam forming electrodes and beam focusing electrodes, the improvement comprising said beam forming electrodes including a cathode, a control grid adjacent to said cathode and two screen grids, a first of said screen grids being adjacent to a side of said control grid opposite said cathode and a second screen grid being between said first screen grid and said beam focusing electrodes, said gun including means for electrically exciting said electrodes, said first screen grid being electrically excited to a higher potential than said second screen grid.

4. The electron gun as defined in claim 3 wherein said second screen grid and said control grid are at the same electrical potential.

5. The electron gun as defined in claim 4 wherein said second screen grid and said control grid are grounded.

6. The electron gun as defined in claim 3 wherein said second screen grid has a negative electrical potential applied thereto.

7. In an electron gun for use in a cathode ray tube, said gun including beam forming electrodes and beam focusing electrodes, the improvement comprising said beam forming electrodes including a cathode and at least three grids spaced from said cathode and spaced from each other, the grid closest to said cathode and the grid farthest from said cathode being connected to ground.

8. In an electron gun in a cathode ray tube, said gun including beam forming electrodes and beam focusing electrodes, the improvement comprising said beam forming electrodes including a cathode and at least three grids spaced from said cathode and spaced from each other, the grid closest to said cathode and the grid farthest from said cathode being electrically connected within said tube.

9. In an electron gun for use in a cathode ray tube, said gun including electrodes comprising a beam forming region and electrodes comprising a beam focusing region, wherein said electrodes are excited by suitable voltages applied to said electrodes, the improvement comprising said beam forming region including a cathode and at least three grids spaced therefrom, the voltages applied to said grids establishing a general axial electrostatic field for accelerating electrons from said cathode, a minor portion of the axial electrostatic field being reversed for retarding acceleration of electrons, and wherein the grid closest to said cathode is grounded, the second closest grid has a positive potential applied thereto, and the third closest grid is grounded.

10. The electron gun as defined in claim 9 wherein the retarding portion of the axial electrostatic field is located near said second closest grid.

11. The electron gun as defined in claim 10 wherein the retarding portion of the axial electrostatic field extends from near a central portion of said second closest grid to the space between the second and third grids.

12. The electron gun as defined in claim 1, 3, 6, 7, 8, or 9 wherein said gun is an in-line gun and each of said grids includes at least three in-line apertures.

13. In a cathode ray tube having an electron gun, said gun including electrodes comprising a beam forming region and electrodes comprising a beam focusing region, wherein said electrodes are excited by suitable voltages applied to said electrodes, the improvement comprising said beam forming region including a cathode and at least three grids spaced therefrom, the grid closest to said cathode being grounded, the second closest grid having a positive potential applied thereto and the third closest grid being grounded.

14. In a cathode ray tube having an electron gun, said gun including electrodes comprising a beam forming region and electrodes comprising a beam focusing region, wherein said electrodes are excited by suitable voltages applied to said electrodes, the improvement comprising said beam forming region including a cathode and at least three grids spaced therefrom, the grid closest to said cathode being grounded, the second closest grid having a positive potential applied thereto and the third closest grid having a negative potential applied thereto.

15. In a television receiver including a cathode ray tube having an electron gun, said gun including electrodes comprising a beam forming region and electrodes comprising a beam focusing region, wherein said electrodes are excited by suitable voltages applied to said electrodes, the improvement comprising said beam forming region including a cathode and at least three grids spaced therefrom, the grid closest to said cathode being grounded, the second closest grid having a positive potential applied thereto and the third closest grid being grounded.

16. In a television receiver including a cathode ray tube having an electron gun, said gun including electrodes comprising a beam forming region and electrodes comprising a beam focusing region, wherein said electrodes are excited by suitable voltages applied to said electrodes, the improvement comprising said beam forming region including a cathode and at least three grids spaced therefrom, the grid closest to said cathode being grounded, the second closest grid having a positive potential applied thereto and the third closest grid having a negative potential applied thereto.

* * * * *